United States Patent [19]

Kagohara et al.

[11] Patent Number: 4,615,658

[45] Date of Patent: Oct. 7, 1986

[54] SHROUD FOR GAS TURBINES

[75] Inventors: Hiromi Kagohara; Yutaka Fukui; Masahiko Sakamoto; Nobuyuki Iizuka, all of Hitachi, Japan

[73] Assignee: Hitachi, Ltd., Tokyo, Japan

[21] Appl. No.: 753,882

[22] Filed: Jul. 11, 1985

Related U.S. Application Data

[63] Continuation of Ser. No. 515,977, Jul. 21, 1983, abandoned.

[51] Int. Cl.[4] ..... F01D 25/12; F01D 11/08

[52] U.S. Cl. ..... 415/178; 415/180; 415/200; 415/170 R; 415/139; 148/442; 148/327; 428/678; 420/584; 420/585; 420/36; 420/38; 420/47; 420/48

[58] Field of Search ..... 415/200, 217, 196, 178, 415/180, 212 R, 212 A, 170 R, 139; 416/241 R; 148/38; 75/128 R, 128 G, 128 T; 428/678, 685

[56] References Cited

U.S. PATENT DOCUMENTS

| | | | |
|---|---|---|---|
| 2,801,916 | 8/1957 | Harris et al. | 148/38 |
| 2,857,266 | 10/1958 | Anger | 148/38 |
| 3,135,602 | 6/1964 | Eberle | 148/38 |
| 3,505,028 | 4/1970 | Douthit | 428/678 |
| 3,617,261 | 11/1971 | Lherbier | 148/428 |
| 3,794,445 | 2/1974 | Watanabe et al. | 416/241 R |
| 3,957,545 | 5/1976 | Mimino et al. | 148/38 |
| 3,975,112 | 8/1976 | Brown et al. | 415/178 |
| 4,086,107 | 4/1978 | Tanino et al. | 148/38 |
| 4,169,020 | 9/1979 | Stalker et al. | 415/174 |

FOREIGN PATENT DOCUMENTS 54-110917 8/1979 Japan .

OTHER PUBLICATIONS

Stainless and Heat-Resisting Steels Products Manual, AISI, 1974, U.S. Stainless and Heat-Resistant Steels Table.

*Primary Examiner*—Robert E. Garrett
*Assistant Examiner*—Edward Li
*Attorney, Agent, or Firm*—Antonelli, Terry & Wands

[57] ABSTRACT

This invention relates to an improvement on material of a shroud for gas turbines. The material comprises 0.25–0.7 wt % C, 20–35 wt % Cr, 20–40 wt % Ni and balance Fe, and has an austenitic structure. The amount of the $\sigma$-phase in this invention is less than 5% and Nv value (Electron Vacancy Number) is less than 2.8.

10 Claims, 9 Drawing Figures

(NO. 1)

(NO. 5)

(NO. 8)

THERMAL FATIGUE CRACK LENGTH (mm)
20
15
10
5
0
2.3
2.5
2.7
2.9
3.1
$\overline{Nv}$ VALUE 800°C, 1000hr CREEP RUPTURE STRENGTH (Kgf/mm²)
10
8
6
4
2
0
NO.1
NO.8
NO.4
NO.5
SAMPLE NO.

(a)

(b)

(c)

SHROUD FOR GAS TURBINES

This is a continuation of application Ser. No. 515,977, filed July 21, 1983, abandoned.

BACKGROUND OF THE INVENTION

This invention relates to a shroud for gas turbines which is mounted on the inside of a turbine casing so as to face the tips of moving blades with a gap therebetween, and more particularly to the shroud made of austenitic, heat-resistant, Fe-Ni-Cr-base alloy steel which is superior in thermal fatigue resistance and creep rupture strength.

The shroud for gas turbines, which is exposed to a corrosive gas at one side and to coolant at the other side, easily suffers repeated thermal stress which leads to deformation or cracking. Further, the shroud faces the tips of the moving blades with a small gap, so that its deformation causes the danger that the shroud contacts with the moving blades. When a shroud for gas turbines is repeatedly subjected to a corrosive gas of high temperature, large thermal stress is repeatedly produced thereby.

Recently, highly efficient gas turbines which use higher temperature gas than that used in a conventional gas turbine have been developed, and metal temperature of the shroud has reached to a temperature of 650°–900° C. For the shroud, Fe-25Cr-20Ni alloy steel equivalent to CK20 has been used. Generally, the shroud is subjected to high thermal stresses which lead to deformation or cracking. It was found that the CK20 alloy is prone to crack from thermal fatigue and its life is shortened.

On the other hand, blades for gas turbines are exposed to atmosphere of higher temperature than the shroud. Alloy of higher strength for high temperature use, for example, nickel-base alloy or cobalt-base alloy disclosed in U.S. Pat. No. 4,169,020, is used. These materials, however, include a lot of expensive Ni and Co and their thermal fatigue property is superior to that of the CK20. However, the shroud made of Ni-base or Co-base alloy is very expensive.

SUMMARY OF THE INVENTION

An object of the invention is to provide a shroud for gas turbines which is made of relatively low cost Fe-Ni-Cr-base alloy steel and has superior thermal fatigue resistance and high temperature corrosion resistance.

Another object of the invention is to provide a shroud for gas turbines, made of relatively low cost Fe-Ni-Cr-base alloy steel which has superior thermal resistance and high temperature corrosion resistance, and can be melted and cast in atmosphere.

The inventors examined and analysed cracks in CK20 alloy steel in detail. It was found that cracks occur from thermal fatigue, and propagate along at grain boundaries. The causes of cracks are: (1) that a large amount of needle-shaped, brittle $\sigma$-phases precipitate in grains and film-shaped $\sigma$-phases form continuously at grain boundaries; (2) that these $\sigma$-phases crack due to thermal stress, and grains with needle-shaped, brittle $\sigma$-phases tend to become less active in plastic deformation in stress loading, resulting in piling-up of large stress concentration at grain boundaries which leads to crack propagation along at grain boundaries; (3) grain boundary penetration occurs at grain boundaries, which accelerate crack propagation in combination with fatigue stress. The phenomena are peculiar to gas turbine shrouds, because according to analysis of thermal stresses produced in a material for the shroud in case of repeated start and stop of the gas turbine, the maximum stress reaches to several tens kgf/mm$^2$, and the precipitation of $\sigma$-phases of detrimental shapes to the thermal fatigue in a heated shroud under such a high stress is significantly accelerated. Generally, the $\sigma$-phases in CK20 alloy steel are precipitated at grain boundaries even when the shroud is heated for a long time under no loading. These $\sigma$-phases, however, are massive and discontinuous in shape, which do not lead to thermal fatigue cracking.

The present invention is made on the above, and characterized in that the shroud comprises 0.25–0.7 wt% C, 20–35 wt% Cr, 20–40 wt% Ni and Fe, and has an austenitic structure. More preferably, the shroud consists essentially of 0.30–0.5 wt% C, 20–30 wt% Cr, 20–35 wt% Ni, at least one selected from a group consisting of 0.1–0.5 wt% Ti, 0.1–5 wt% Nb, 0.05–0.5 wt% rare-earth elements, 5–20 wt% Co, less than 7 wt% W and/or Mo, less than 2 wt% Mn, less than 2 wt% Si and balance Fe, and has an austenitic structure.

The limited compositions of the chemical components are explained hereinafter, wherein the following percentages are referred to as weight percentages except for the particularly defined.

C: C is a very important element to improve thermal fatigue property and high temperature strength. Less than 0.25% C makes it easy for $\sigma$-phases to precipitate, and at the same time, it is undesirable because film-shaped $\sigma$-phases tend to appear continuously at grain boundaries. On the other hand, an amount of brittle eutectic carbides and secondary carbides increase with increasing the C content, which results in lowering thermal fatigue property. Therefore, the carbon content is 0.25–0.7%, particularly 0.35–0.5%, the most preferable.

Cr: More than 20% Cr is necessary to suppress grain boundary penetration due to high temperature corrosion. Further, it is not preferable to be more than 35% in view both of precipitation of an excess amount of carbides during high temperature use and of brittleness due to precipitation of $\sigma$-phases. Therefore, the content of Cr is limited to 20–35%, and particularly preferably 20 to 30%.

Ni: Ni makes a base alloy austenitic, increases high temperature strength, and more than 20% is necessary to prevent precipitation of $\sigma$-phases by making the matrix more stable. Further, Ni is desirable to be much in view of high temperature corrosion resistance. However, when the content is more than 40%, the amount of eutectic carbides increase so that thermal fatigue property is lowered. Therefore, the content is 20–40%, and particularly preferable to be 20–35%.

Ti, Nb: These elements form MC type carbides such as TiC where only Ti is added, NbC where only Nb added, and (Ti, Nb)C where Both Nb and Ti added. These MC type carbides are not effective for high temperature strength increase; however, they suppress the growth of secondary Cr-carbides which are effective for high temperature strength increase, and maintain high temperature strength for a long time. Further, these elements prevent continuous precipitation of Cr-carbides at grain boundaries. Addition of a small amount of them is less effective for high temperature strength increase, and addition of a large amount increases MC type carbides and reduces precipitation of the secondary Cr-carbide so that high temperature strength is lowered. M/C (M is added metal elements forming MC type carbides) is the most preferable to be 0.2–0.3 by atomic ratio. Therefore, Ti and Nb are 0.1–0.5% and 0.1–5%, respectively.

Rare-earth elements: The rare-earth elements contribute to characteristic improvement by desulfurization and deoxidation, however; the addition of small amount of them does not bring any effects, and too much amount leads to the formation of brittle, low melting point eutectic compound thereby to cause casting cracking and machining cracking. Therefore, addition of them is preferable to be 0.05–0.5%. An alloy according to the invention has sufficient thermal fatigue property and high temperature strength even if the rare-earth elements are not added.

W, Mo: W, Mo are added to strengthen a base material by solid solution hardening. The more an amount of the elements is added, the more the strength increases. However, $\overline{N}v$ value (Electron Vacancy Number) increases with increasing the amount of Mo or W. When the amount of Mo or W is more than 7%, a lot of eutectic carbides are formed and the thermal fatigue property and weldability are lowered. In this invention, even if W and Mo are not added, sufficient high-temperature strength is kept and the materials without Mo or W can be available as shroud material.

Co: more than 5% Co is added to strengthen a base material by solid solution hardening, but addition of more than 20% does not bring effects in proportion to the amount added. Therefore, addition of 5–20% Co is suitable. Shrouds used at a temperature of less than 800° C. has sufficient high-temperature strength even if Co is not added.

Further, where $\sigma$-phase is more than 5%, it lowers remarkably thermal fatigue resistance. Therefore, the $\sigma$-phases must be less than 5%. In this invention the $\overline{N}v$ (Electron Vacancy Number) value expressed by the following must be less than 2.8.

$$\overline{Nv} = \left[ 0.66\text{Ni} + 1.71\text{Co} + 2.66\text{Fe} + 3.66\text{Mn} + 4.66\text{Cr} - \{\text{C} - (\text{Ti} + \text{Nb})\} \times \frac{23}{6} \times 4.66 + 4.66(\text{Mo} + \text{W}) + 6.66\text{Si} \right] /100$$

wherein Ni, Co, Fe, Mn, Cr, Mo, W, Ti, Nb and Si in the above equation are denoted by atomic percent, respectively.

Si, Mn are added as deoxidizers, but the amount to be added is preferable to be a little, less than 2% is suitable, and particularly preferable to be less than 1%.

In this invention, shrouds are made of an alloy of compositions as above-mentioned by forming it in a predetermined shape, for example, by casting method. After casting, it is preferable to subject to heat treatment to improve mechanical properties of the shroud. A solid solution treatment method is required to stabilize the casting structure.

DESCRIPTION OF THE PREFERRED EMBODIMENTS

Figure 1:
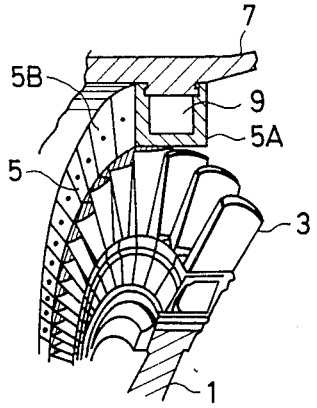
FIG. 1 is a perspective view showing a shroud portion for a gas turbine.
Figure 2:
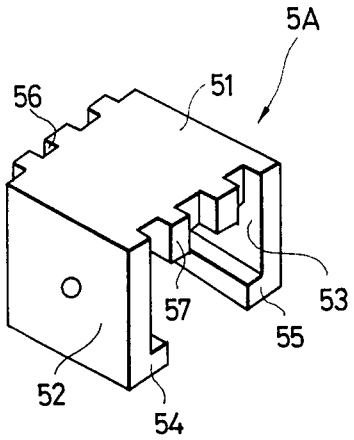
FIG. 2 is a perspective view of a shroud element.

FIGS. 1 and 2 show a shroud for a gas turbine.

In FIG. 1, a rotor 1 is provided with a plurality of radially extending blades 3 and driven by a high temperature gas acting thereon. A shroud 5 is arranged annularly so as to face the tips of the blades 3 with a small gap, and mounted on a turbine casing 7. The shroud 5 comprises a plurality of segments 5A, one of which, as shown in FIG. 2, comprises a front portion 51 facing the blades 3 with the small gap, side portions 52, 53 extending perpendicularly to the front portion 51, fixing portions 54, 55 fixed to the turbine casing 7 at the ends of the side portions 52, 53, and connecting portions 56, 57 at the ends of the front portion 51. The connecting portion 56 of the segment 5A is formed so as to fit a connecting portion 57 of a segment 5B adjacent thereto. And, all the shroud segments 5A, 5B form a ring-shaped shroud 5 through such fitting.

Referring back to FIG. 1, the shroud 5 forms a cooling air passage 9 together with a part of the turbine casing 7. A compressed air from a compressor, passing through the air passage 9, cools the shroud 5. In case of the shroud being subjected to a gas at a high temperature of about 1100° C., the shroud is cooled to about 700°–750° C. The dimension of the gap between the shroud 5 and the tips of the blades influences greatly turbine operating efficiency. The small gap is desirable from the standpoint of the turbine operating efficiency. The shroud deformation from thermal fatigue and thermal expansion should be minimum to maintain the small gap between the shroud 5 and the tips of the moving blades 3. However, the conventional shroud material is prone to be cracked i.e. the front portion 51 due to mainly thermal fatigue.

Examples of material of the shroud 5 according to the present invention are described hereinafter.

Table 1 shows chemical composition (weight %) and $\overline{N}v$. In the table 1, a sample No. 1 is a conventional alloy which is used for comparison, samples No. 2 to No. 8 are alloys according to the present invention. From the table 1, it is noted that $\overline{N}v$ of the sample No. 1 is about 2.9 while $\overline{N}v$ of alloys according to the present invention are less than 2.9, that is, 2.327 to 2.788. Thermal fatigue resistance test was made on these alloys.

Figure 3A:
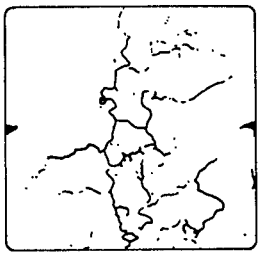
FIGS. 3A to 3C are front views showing crack propagation of samples.
Figure 3B:
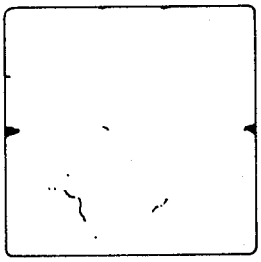
Figure 3C:
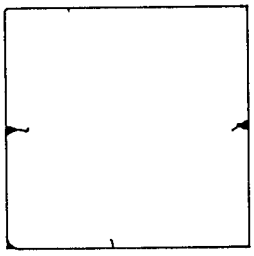
Figure 4:
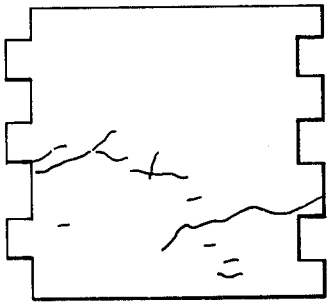
FIG. 4 is a front view of a conventional shroud element.

The each sample was subjected to solution treatment (cooling in air after holding at 1150° C. for 2 hours) after casting and then bars of 25 mm $\phi \times$ 100 mm l were prepared by casting method. Test pieces (20 mm $\phi \times$ 20 mm l with V-notch) for thermal fatigue evaluation were made from the bar, and evaluation of thermal fatigue property was made by measuring the total crack length after 150 cycles of water cooling and holding at 750° C. for 30 minutes. Thermal fatigue cracks are shown in FIGS. 3A to 3C. In the sample No. 1 shown in FIG. 3A, many cracks can be observed. The mode of cracks of test samples are quite similar to those of the shroud used for gas turbines. The sample No. 8 shown in FIG. 3C has a very few cracks compared with the sample No. 1. The mode of cracks of samples No. 2 to No. 4, No. 6 and No. 7 are quite similar to that of the sample No. 8. There appears crack propagation in the sample No. 5, of the highest $\overline{N}v$ among samples No. 2 to No. 8, which is shown in FIG. 3B, but the propagation length is negligibly small as compared with the sample No. 1 of the conventional material.

Figure 5:
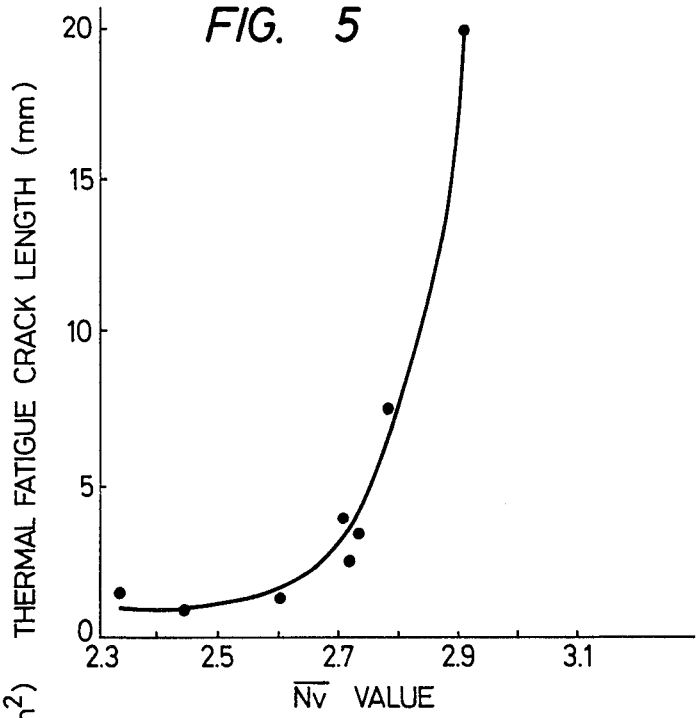
FIG. 5 is a graph showing a relation between $\overline{N}v$ value and thermal fatigue crack length.

FIG. 5 shows a relation between the $\overline{N}v$ and thermal fatigue crack length. Since the sample No. 1 has a lot of cracks i.e. branching of cracks and penetration from a side to the opposite side, so it is hard to measure the crack length. In this case, 20 mm, the entire width of the sample, is regarded as the crack length. It is noted from FIG. 5 that the samples less than 2.8 of $\overline{N}v$ are superior in the thermal fatigue property.

TABLE 1

| No. | C | Si | Mn | Ni | Cr | Nb | Ti | W | Mo | Co | misch metal | Fe | $\overline{N}v$ |
|---|---|---|---|---|---|---|---|---|---|---|---|---|---|
| 1 | 0.1 | 0.9 | 1.0 | 20 | 25 | — | — | — | — | — | — | the rest | 2.899 |
| 2 | 0.4 | 0.8 | 1.0 | 23 | 25 | 0.3 | 0.2 | — | — | — | — | " | 2.714 |
| 3 | 0.4 | 1.0 | 0.9 | 25 | 26 | 0.3 | 0.2 | — | — | — | 0.3 | " | 2.709 |
| 4 | 0.41 | 1.1 | 0.95 | 26 | 25 | 0.25 | 0.18 | 5 | — | — | 0.3 | " | 2.704 |
| 5 | 0.42 | 1.1 | 1.2 | 25 | 27 | 0.3 | 0.2 | 7 | — | — | 0.3 | " | 2.788 |
| 6 | 0.42 | 1.0 | 1.0 | 30 | 26 | 0.31 | 0.15 | — | 2 | 15 | 0.3 | " | 2.477 |
| 7 | 0.40 | 1.2 | 1.0 | 35 | 25 | 0.30 | 0.15 | 3 | 2 | 15 | 0.3 | " | 2.327 |
| 8 | 0.40 | 0.6 | 0.5 | 25 | 23 | 0.25 | 0.25 | — | — | — | — | " | 2.607 |

Figure 6:
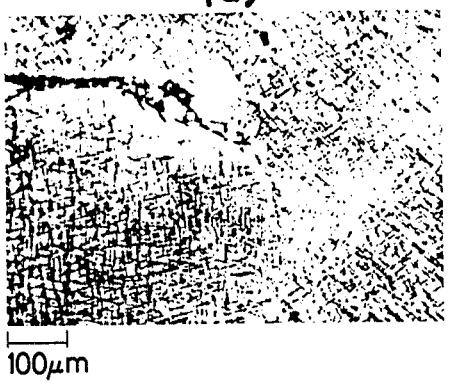
FIG. 6 is microscopic structures of shroud material, wherein (a) and (b) are of conventional material, and (c), of material according to the present invention.
Figure 6:
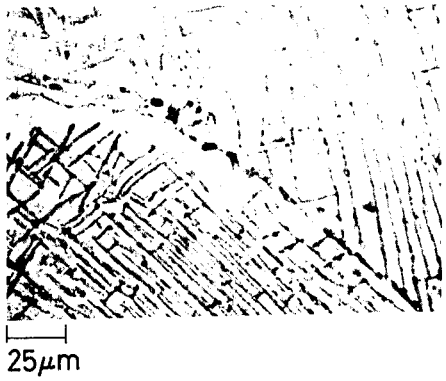
Figure 6:
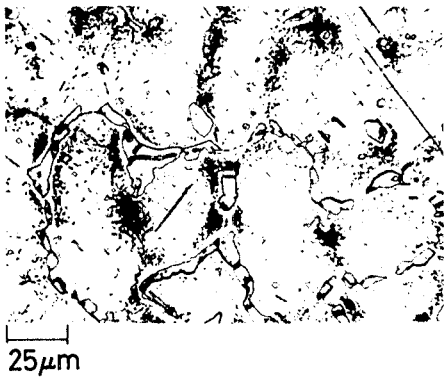

Further, FIG. 6 shows the microstructure of a shroud made of the sample No. 1 and the microstructure of a shroud made of the sample No. 3, which have been used for one year. In FIG. 6, (a) and (b) show the crack propagation along grain boundaries, the film-shaped $\sigma$-phases at grain boundaries and a lot of needle-shaped $\sigma$-phases in grains. On the other hand, in the shroud material, shown in (c), according to the present invention, $\sigma$-phase is hard to be observed, and carbides at grain boundaries are discontinuous, and very few cracks occur.

Figure 7:
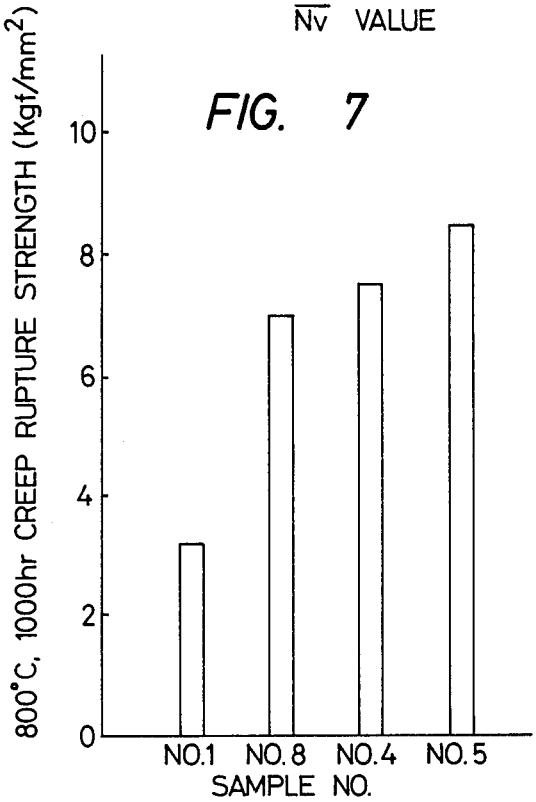
FIG. 7 is a graph showing 800° C., 1000 hr creep rupture strength of samples.

In FIG. 7, creep rupture strength at 800° C., for 1000 hr of the samples No. 1, No. 4, No. 5, and No. 8 is shown. The sample alloys according to the present invention show superior creep rupture strength compared with the conventional material.

In this invention, from the standpoint of mechanical properties (thermal fatigue resistance, creep rupture strength) and high temperature corrosion resistance together with economical point of materials, the composition of sample No. 8 without Co and W is the most preferable. For the practical use, the most preferable compositions of this invention are as follows:

0.35–0.5 wt% C, less than 0.8 wt% Si, 0.1–1.2 wt% Mn, 24–26 wt% Ni, 22–24 wt% Cr, 0.2–0.5 wt% Nb, 0.15–0.35 wt% Ti and balance Fe.

In the present invention, the same effect can be expected by adding MC type carbide forming element such as Zr, Hf, V etc in place of Ti, Nb.

As above-mentioned, the shroud according to the present invention is superior in thermal fatigue property, high temperature strength and high temperature corrosion resistance and corrosion, so that its life can be extended remarkably. Further, the shroud is low in cost, easy to be melted and cast in atmosphere and superior in weldability.

What is claimed is:

1. A shroud for a gas turbine casing, adapted to be mounted on a gas turbine casing so as to face the tips of moving turbine blades with gaps between the turbine blade tips and the shroud, the shroud having a front portion facing the blade tips, and side portions provided at both sides of said front portion to fit said turbine casing, thereby to form a passage for coolant together with a part of said turbine casing, which shroud has an austenitic structure and consists essentially of 0.35–0.5 wt% C; 22–24 wt% Cr; 24–26 wt% Ni; 0.15–0.35 wt% Ti; 0.2–0.5 wt% Nb; 0.1–1.2 wt% Mn; and less than 0.8 wt% Si; and balance Fe.

2. The shroud as defined in claim 1, wherein a $\sigma$-phase containing ratio is less than 5% and $\overline{N}v$ calculated according to the following equation is less than 2.8:

$$\overline{N}v = \Big[0.66Ni + 1.71Co + 2.66Fe + 3.66Mn + 4.66Cr - \{C - (Ti + Nb)\} \times \frac{23}{6} \times 4.66 + 4.66(Mo + W) + 6.66Si\Big] /100$$

wherein each of Ni, Co, Fe, Mn, Cr, Mo, W, Ti, Nb and Si is denoted by atomic percent.

3. The shroud as defined in claim 1, wherein said shroud is made by casting and solid solution treatment after the casting.

4. The shroud as defined in claim 3, wherein the casting is performed in the atmosphere.

5. The shroud as defined in claim 1, said shroud having further added thereto at least one element selected from the group consisting of 0.05–0.5 wt% rare-earth elements, 5–20 wt% Co, less than 7 wt% W and less than 7 wt% Mo.

6. The shroud as defined in claim 5, wherein the shroud is formed by casting, and is subjected to solution treatment after casting.

7. The shroud as defined in claim 6, wherein the casting is performed in the atmosphere.

8. The shroud as defined in claim 5, wherein any carbides formed at grain boundaries of the shroud are discontinuous.

9. The shroud as defined in claim 1, wherein aany carbides formed at grain boundaries of the shroud are discontinuous.

10. A shroud for a gas turbine to be mounted on a turbine casing so as to face the tips of moving blades of the gas turbine with a gap between the moving blade tips and said shroud, said shroud consisting essentially of 0.35–0.5 wt% C, less than 0.8 wt% Si, 0.1–1.2 wt% Mn, 22–24 wt% Cr, 24–26 wt% Ni, 0.2–0.5 wt% Nb, 0.15–0.35 wt% Ti, and balance Fe, having an austenitic structure, and having a $\sigma$-phase containing ratio of less than 5%, whereby a shroud having a sufficiently high thermal fatigue resistance such that said shroud does not crack substantially during use in the gas turbine is formed.

* * * * *